US005207022A

United States Patent [19]

Watt

[11] Patent Number: 5,207,022

[45] Date of Patent: May 4, 1993

[54] SECURITY CLOSURE

[75] Inventor: Ronald W. Watt, Glasgow, Scotland

[73] Assignee: SPS (Holdings) Ltd., Glasgow, Scotland

[21] Appl. No.: 823,955

[22] Filed: Jan. 23, 1992

[30] Foreign Application Priority Data

Jan. 24, 1991 [GB] United Kingdom ..... 9101534

[51] Int. Cl.[5] ..... E06B 9/00

[52] U.S. Cl. ..... 49/50; 49/460; 52/208

[58] Field of Search ..... 49/50, 61, 460; 52/202, 52/203, 208, 507, 508

[56] References Cited

U.S. PATENT DOCUMENTS 4,057,935 11/1977 Rohrberg et al. .
4,467,574 8/1984 Falge et al. ..... 49/50 X
4,514,932 5/1985 Janis ..... 49/50

FOREIGN PATENT DOCUMENTS

A-2045321 10/1980 United Kingdom .
1594960 5/1981 United Kingdom .
A-2160248 12/1985 United Kingdom .
A-2208171 3/1989 United Kingdom .

*Primary Examiner*—Philip C. Kannan
*Attorney, Agent, or Firm*—Keck, Mahin & Cate

[57] ABSTRACT

A security closure for a door or window opening, said closure comprising a panel of sheet material having an inner face and an outer face and a plurality of apertures therein, extending through the panel between said faces, and at least two elongate pin members each pin member having a blank head, the pin members each passing through a separate one of the apertures with the head thereof in individual abutting engagement with the outer face of the panel. A connecting member, such as a wire or an integral bolt is formed integrally with or connected to the pin on the side thereof inside the inner face and cooperates directly or indirectly with the surround of the door or window opening, whereby tensioning of the connecting member will pull the panel into the opening.

18 Claims, 2 Drawing Sheets

SECURITY CLOSURE

The present invention relates to a security closure for use in particular in windows, doors and like openings in temporarily unoccupied premises.

Property which is temporarily vacant for one reason or another, for example, during building renovation or between tenancies is being increasingly subjected to damage due to theft and vandalism. Early attempts to protect such property involved securing wooden or reinforced panels to the outer skin of the building around the opening. The means of fixing the panels could be easily accessible from the outside and so lack security.

One proposal of security closure as shown in GB-A-2160248, involves the use of a panel having peripherally extending sidewalls with inwardly turned rim portions so arranged as to captively retain the end portions of at least two elongate support members so as to permit lateral sliding movement of the support members in a direction parallel to the opposed sides, while restraining them against movement perpendicular to the principal plane of the panel. At least two spaced apart elongate connectors, such as screws, are used to connect these support members to anchor means, again usually in the form of elongate bars which have a length not substantially less than the length of width of the panel.

GB-A-2045321 involves the use of a flat sheet around the edges of which are secured clips which are used to connect wires which pull the panel rearwardly against the window frame.

GB-A-2208171 shows another system involving panels having a peripheral flange with a rim and a connector, e.g. a strip of metal or wire, is connected to the peripheral flange and is again used to pull the panel against the outside of the window frame.

While these structures all work reasonably satisfactorily, they are somewhat expensive and difficult to install.

It is now proposed, according to the present invention, to provide a security closure for closing a door or window opening in a building, said closure comprising a panel of sheet metal having inner and outer faces and a plurality of apertures formed therein, extending through the panel between said faces, and at least two elongate pin members, each pin member having a blank head, the pin members each passing through a separate one of the apertures with the head thereof in individual abutting engagement with the outer face of the panel, a connecting member formed integrally with, or connected to, the pin on the side thereof inside said inner face and cooperating directly or indirectly with the surround of the door or window opening, whereby tensioning of said connecting member will pull the panel against the opening.

Such a structure can be made inexpensively and yet provides fully satisfactory results after having been installed very simply and quickly.

The apertures may be circular, but are preferably polygonal, e.g. square. The holding pins may have a complementary e.g. square cross-section shank adjacent the head.

Alternatively the pin may be in the form of a bolt onto which is threaded a nut abutting the inner face of the panel, the panel being securely clamped between the head of the bolt and the nut.

In certain structures according to the invention, the connecting member may be in the form of a flexible element such as a wire or metal tape. With such a structure the wire or metal tape could pass through a threaded tube and a tensioning bolt may be threaded onto said threaded tube, and the wire may be clamped to the tensioning bolt at the end thereof remote from the panel, whereby relative rotation between the tensioning bolt and the threaded tube tensions the flexible element.

In an alternative arrangement, again two anchor means are provided, of a length not substantially less than the height or width of the panel, the anchor means including a further bolt for each flexible element, and wherein the pins which are each passed through an aperture of the panel and the further bolt are each formed with a transverse bore through which the wire extends.

The further bolt may be provided with a clamping nut to secure the wire and additionally, each pin may be in the form of a bolt into which is inserted a nut abutting the inner face of the panel, the panel pins being securely clamped between the head of the bolt and said nut.

If anchor means are not used, the flexible connecting element may be passed through a hole bored in the window frame or door frame and a nut, or the threaded tube arrangement mentioned earlier, may be provided to tension the flexible wire or metal tape.

An alternative approach is for each connecting means to be in the form of an integral portion of the pin having associated therewith a nut. The nut may be adapted to abut directly the door or window frame or the assembly may further comprise at least two anchor means which are of a length not substantially less than the height or width of the panel, the bolts passing through the anchor means and having nuts located on the face thereof remote from the panel.

In order that the present invention may more readily be understood, the following description is given, merely by way of example, reference being made to the accompanying drawing which:

Figure 1:
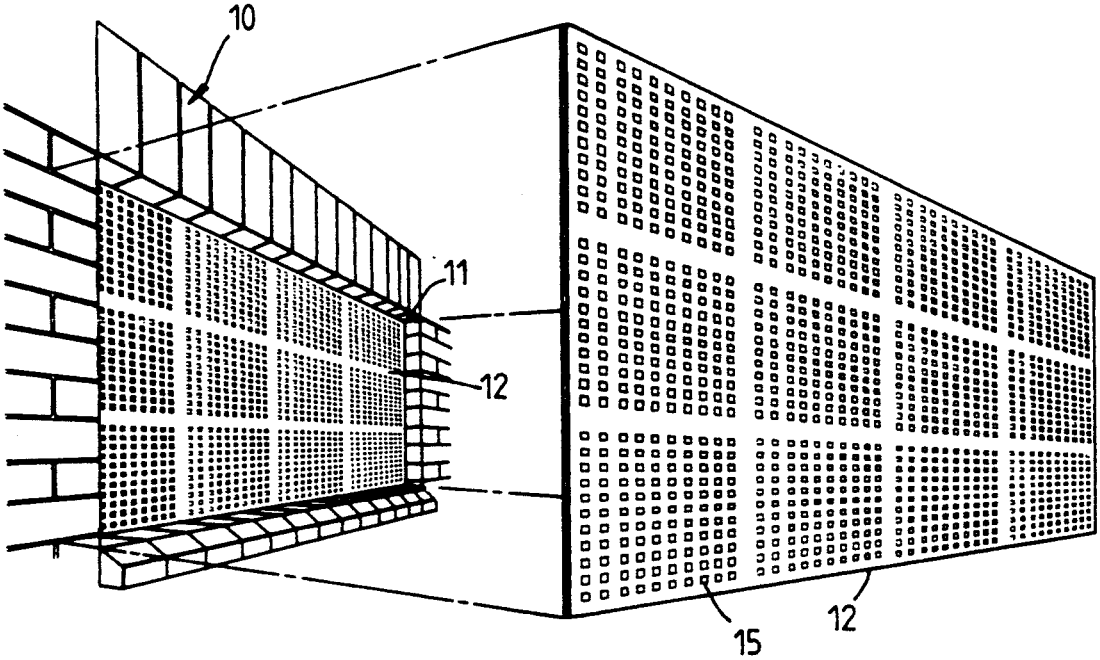
FIG. 1 is a schematic exploded view of one embodiment of security closure according to the invention fitted into a window opening.

FIG. 1 illustrates a wall 10 having a window opening 11 therein and a security panel 12 according to the invention mounted within the window opening 11 completely to fill that opening. The panel 12 has a front and rear face 13,14 respectively (FIG. 2) and is perforated with square cross-section apertures 15 extending between the front and the rear faces.

Figure 2:
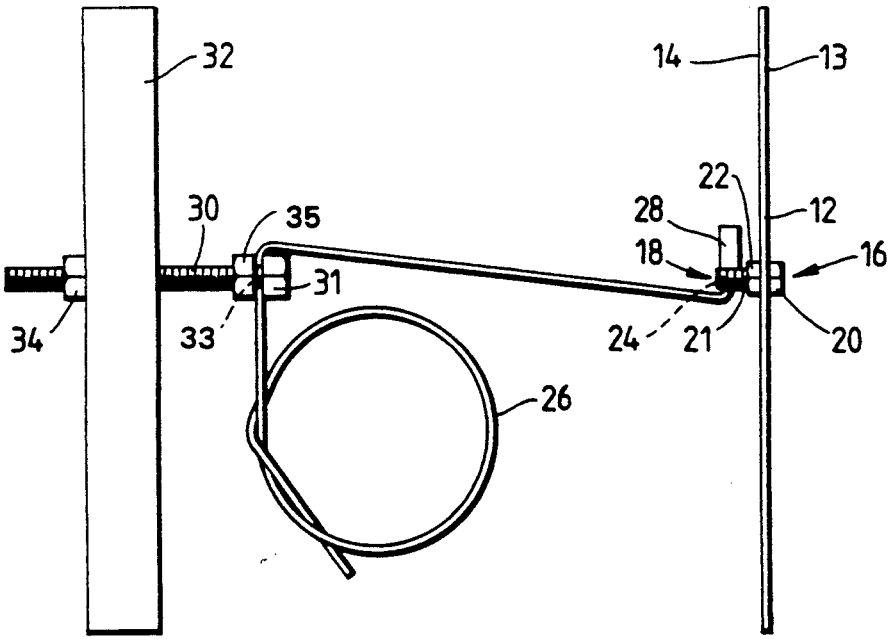
FIG. 2 is a schematic side elevation of the security closure of FIG. 1.

Inserted into the apertures 15 are elongate holding pins indicated by the general reference numerals 16 (FIG. 2). Each holding pin consists of a bolt 18 having a blank head 20, the threaded shank 21 of the bolt having a nut 22 screwed thereonto whereby the nut abuts the rear face 14, with the bolt head 20 abutting the front face 13 of the panel.

A transverse bore 24 is formed in the shank 21 and through this is passed a connecting wire 26. It will be seen that above the bolt the connecting wire is provided, at its end, with an abutment, e.g. in the form of a sleeve 28 crimped onto the wire.

A further bolt 30 having a head 31 is secured to an anchor bar 32 by means of a nut 34 and the wire 26 is passed through a further transverse bore 36 in the bolt 30 and is held in place by a clamping nut 38

The anchor bar 32 is placed so that its end portions abut the inner face of the wall 10 and tension is applied to the wire and when it is fully tensioned the clamping nut is secured.

It can be seen that the structure illustrated is very simple and can be made relatively inexpensively. The wire is preferably a galvanised multi-strand wire. The structure of the present invention has great flexibility and can secure windows of any width, in practice up to 900 mm, in a wall of any thickness. Components are all re-usable many times over and can be replaced individually.

Figure 3:
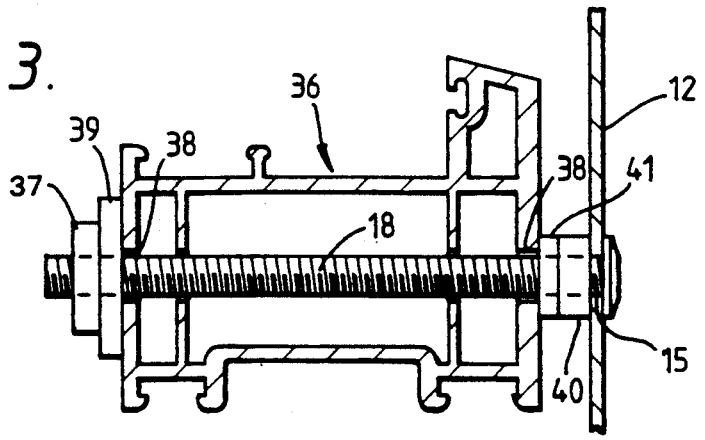
FIGS. 3, 4 and 5 are each a similar view of three modified structures.

FIG. 3 shows a modified arrangement. The window opening (or a door opening) has a conventional frame member 36. When it is decided to secure a panel 12 in place, a hole 38 is bored at each of a number of locations around the frame, the holes being drilled accurately to be aligned with certain of the apertures 15. Elongate bolts 18 are then passed through apertures 15 and the aligned holes 38. A nut 37 is then threaded onto the bolt, with or without the provision of a washer 39. When the nuts 37 are all tightened up, the panel 12 will be securely held. This arrangement has the advantage that it is unnecessary to remove glazing from the window. After removal of the panel, the holes 38 can be plugged.

FIG. 3 also illustrates the possible provision of a further nut 40 which is used to secure the bolt 18 against the panel 12 and a washer, e.g. of plastics material, is indicated by the reference numeral 41.

Figure 4:
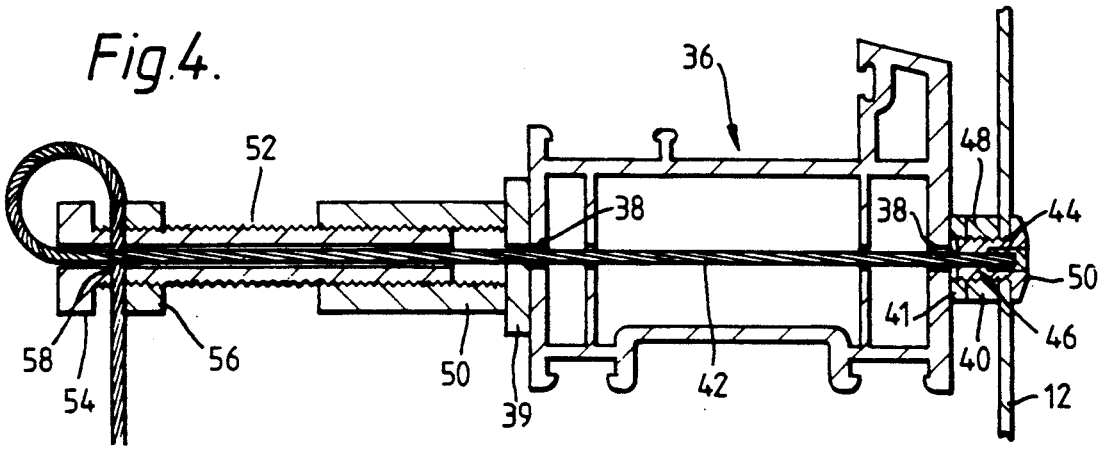

FIG. 4 shows a similar concept in which a window frame 36 has a hole 38 bored therethrough. Here, instead of using a bolt 18, a wire 42 having a sleeve 44 crimped onto the wire and engages in a countersunk bore 46 in a bolt 48 having a plain head 50. The bolt is threaded and is engaged against the panel 12 by a nut 40 and a washer 41 is again provided.

Again, a washer 39 is provided at the inner side of the frame 36 and the wire 42 passes therethrough. Also surrounding the wire is a threaded tube 50 and a hollow tensioning bolt 52 is fitted into the tube 50 and has associated therewith a head 54 and a locking nut 56. The wire 42 passes through the head 46 and is passed back through a transverse bore 58 whereby it may be locked against the head 54 by the nut 56. The wire may therefore be tensioned by rotating the tube 50 which may be provided with a conventional hexagonal outer surface to facilitate rotation thereof by a spanner.

Figure 5:
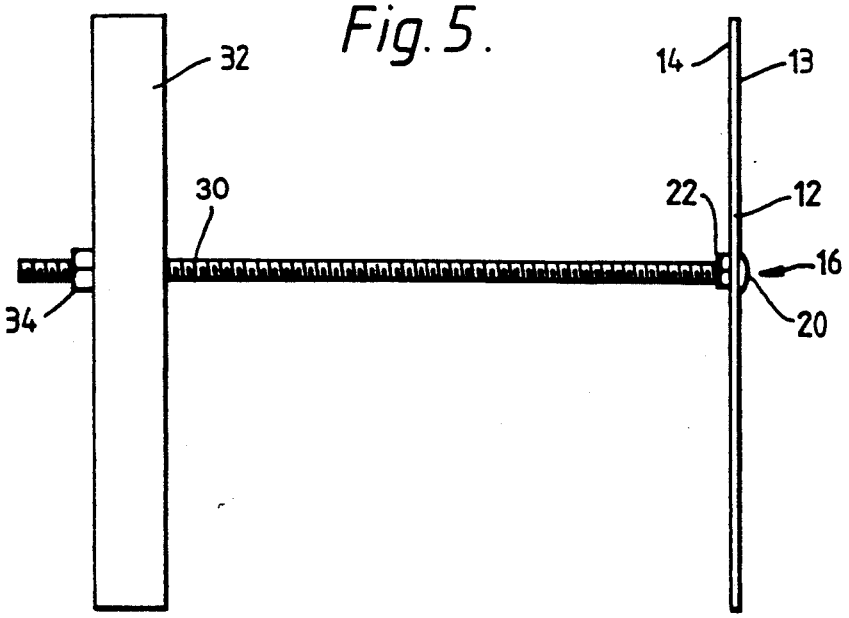

FIG. 5 shows another similar structure in which again a bolt 33 is used, this being passed through an aperture in the panel 12 and secured in place by a holding nut 22.

Associated with the bolt 33 is an anchor bar 32 through which the bolt passes and a nut 34 is provided. The holding bar is fitted on the inside of the frame, the bar having a length not substantially less than the height or width of the panel. Tightening of the nut 34 will clamp the window frame between the panel and the holding bar 32 thereby holding the panel firmly into the frame.

I claim:

1. A security closure for closing a door or window opening in a building, said closure comprising a panel of sheet metal having inner and outer faces and a plurality of apertures formed therein, extending through the panel between said faces, and at least two elongate pin members, each pin member having a blank head, the pin members each passing through a separate one of the apertures with the head thereof in individual abutting engagement with the outer face of the panel, a connecting member formed integrally with, the pin on the side thereof inside said inner face and cooperating directly or indirectly with the surround of the door or window opening, whereby tensioning of said connecting member will pull the panel against the opening.

2. A security closure as claimed in claim 1, wherein said connecting member is in the form of a flexible element, such as a wire or metal tape.

3. A security closure as claimed in claim 2, and further comprising a threaded tube and tensioning bolt threaded into said threaded tube, said wire passing through said tensioning bolt and said threaded tube and means securing said wire to said tensioning bolt at the end thereof remote from said panel, whereby relative rotation between said tensioning bolt and said threaded tube tensions said flexible element.

4. A security closure as claimed in claim 2, and further comprising at least two anchor means of a length not substantially less than the height or width of the panel, and a further bolt for each flexible element and wherein the pins which are each passed through an aperture of the panel and the further bolts each comprise means defining a transverse bore through which the wire extends

5. A security closure as claimed in claim 4, and further comprising a clamping nut threaded onto said further bolt effective to secure the wire.

6. A security closure as claimed in claim 5, wherein each pin is in the form of a bolt and further comprising a clamping nut threaded onto said bolt and abutting the inner face of the panel, the panel being securely clamped between the head of the bolt and the nut.

7. A security closure as claimed in claim 1, wherein each connecting means is in the form of an integral portion of the pin having associated therewith a nut.

8. A security closure as claimed in claim 7, wherein the nut is adapted to directly abut a door or window frame.

9. A security closure as claimed in claim 7, and further comprising at least two anchor means which are of a length not substantially less than the height or width of the panel, the bolts passing through said anchor means and further comprising nuts threaded onto said bolts and located on the face thereof remote from said panel.

10. A security closure for closing a door or window opening in a building, said closure comprising a panel of sheet metal having inner and outer faces and a plurality of apertures formed therein, extending through the panel between said faces, and at least two elongate pin members, each pin member having a blank head, the pin members each passing through a separate one of the apertures with the head thereof in individual abutting engagement with the outer face of the panel, a connecting member connected to the pin on the side thereof inside said inner face and cooperating directly or indirectly with the surround of the door or window opening, whereby tensioning of said connecting member will pull the panel against the opening.

11. A security closure as claimed in claim 10, wherein said connecting member is in the form of a flexible element, such as a wire or metal tape.

12. A security closure as claimed in claim 11, and further comprising a threaded tube and tensioning bolt threaded into said threaded tube, said wire passing through said tensioning bolt and said threaded tube and means securing said wire to said tensioning bolt at the end thereof remote from said panel, whereby relative rotation between said tensioning bolt and said threaded tube tensions said flexible element.

13. A security closure as claimed in claim 12, and further comprising at least two anchor means of a length not substantially less than the height or width of the panel, and a further bolt for each flexible element and wherein the pins which are each passed through an aperture of the panel and the further bolts each comprise means defining a transverse bore through which the wire extends.

14. A security closure as claimed in claim 13, and further comprising a clamping nut threaded onto said further bolt effective to secure the wire.

15. A security closure as claimed in claim 14, wherein each pin is in the form of a bolt and further comprising a clamping nut threaded onto said bolt and abutting the inner face of the panel, the panel being securely clamped between the head of the bolt and the nut.

16. A security closure as claimed in claim 10, wherein each connecting means is in the form of an integral portion of the pin having associated therewith a nut.

17. A security closure as claimed in claim 16, wherein the nut is adapted to directly abut a door or window frame.

18. A security closure as claimed in claim 16, and further comprising at least two anchor means which are of a length not substantially less than the height or width of the panel, the bolts passing through said anchor means and further comprising nuts threaded onto said bolts and located on the face thereof remote from said panel.

* * * * *